United States Patent [19]

Turnbull

[11] 4,170,811

[45] Oct. 16, 1979

[54] METHOD FOR COATING CATHODE MATERIAL ON CATHODE SUBSTRATE

[75] Inventor: John C. Turnbull, Lancaster, Pa.

[73] Assignee: RCA Corporation, New York, N.Y.

[21] Appl. No.: 939,870

[22] Filed: Sep. 5, 1978

[51] Int. Cl.[2] ..... H01J 9/04; H01J 9/12

[52] U.S. Cl. ..... 29/25.16; 29/25.15

[58] Field of Search ..... 29/25.13, 25.14, 25.15, 29/25.16

[56] References Cited

U.S. PATENT DOCUMENTS

| | | | |
|---|---|---|---|
| 3,282,762 | 11/1966 | Stork et al. | 156/253 |
| 3,848,301 | 11/1974 | Gruber | 29/25.16 |

*Primary Examiner*—Richard B. Lazarus

*Attorney, Agent, or Firm*—E. M. Whitacre; G. H. Bruestle; L. Greenspan

[57] ABSTRACT

In a method for making a cathode for an electron tube, after the cathode substrate and at least one apertured grid have been assembled into a mount assembly, an elongated support carrying cathode material is passed through the grid aperture, and cathode material is transferred to the substrate.

10 Claims, 7 Drawing Figures

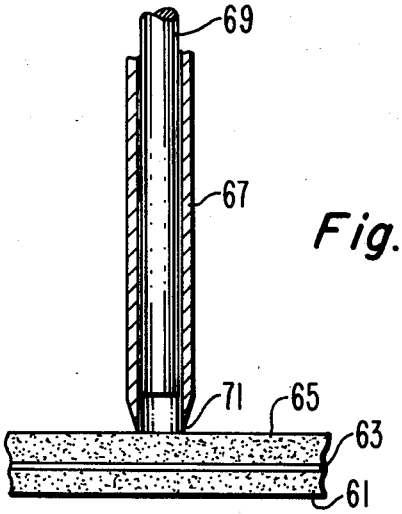
Fig. 2.
Fig. 3.
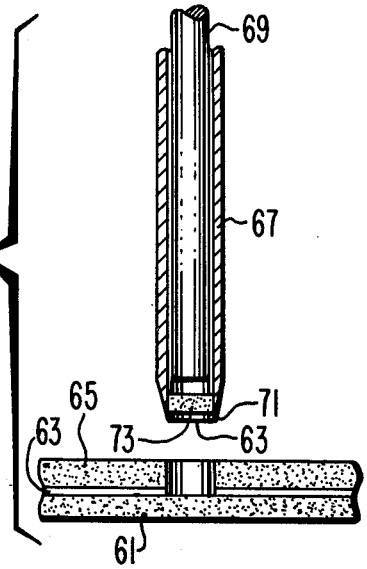
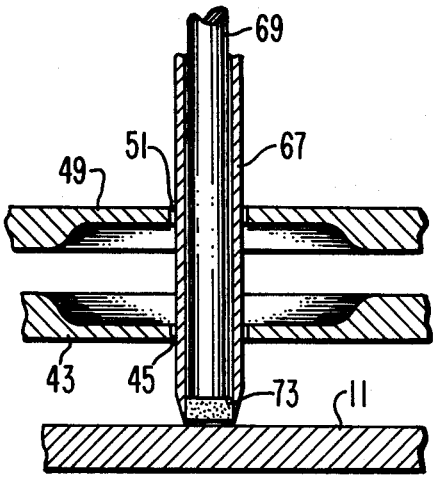
Fig. 4.
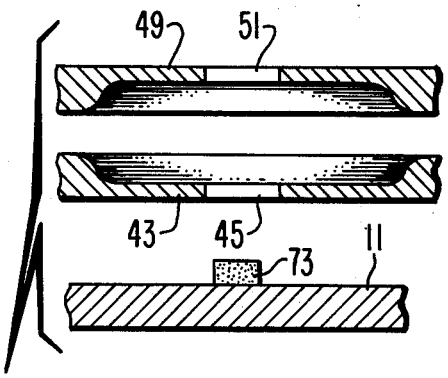
Fig. 5.

METHOD FOR COATING CATHODE MATERIAL ON CATHODE SUBSTRATE

BACKGROUND OF THE INVENTION

This invention relates to a method for coating cathode material onto a cathode substrate for a vacuum electron tube, and particularly for a cathode-ray tube.

A cathode-ray tube includes at least one electron gun, which is a means for producing a highly collimated electron beam. The usual electron gun includes a cathode comprising a cathode substrate carrying a thin layer of electron-emissive material, and at least one grid having a beam-forming aperture therein closely spaced a precise, predetermined distance from the electron-emissive layer. In one design, the layer is smaller than, and concentric with, the beam-forming aperture in order to improve the collimation of the beam.

This one design has been assembled by prior methods of assembly in which the cathode coating is produced on the cathode substrate, one or more grids are fixedly assembled in a mount assembly, and then the coated cathode substrate is fixedly assembled in the mount assembly. Subsequently, the cathode coating is converted to an electron-emissive layer. With the prior methods of assembly, it has proven difficult to assemble the cathode coating concentrically with the grid aperture with the desired accuracy and precision. This deficiency in concentricity with the grid aperture occurs even when the cathode coating is produced on the cathode substrate by punching the cathode coating from a foil and transferring it directly onto the cathode substrate in the punching mechanism, as described, for example, in U.S. Pat. No. 3,282,762 to F. Stork et al.

SUMMARY OF THE INVENTION

In the novel method, after the cathode substrate and at least one grid have been assembled into the mount assembly, an elongated support, such as a rod or hollow needle, carrying cathode material at one end thereof, is passed through the grid aperture, and cathode material is transferred to the substrate. Then, the elongated support is withdrawn through the aperture.

By introducing the cathode material through the grid aperture, the cathode coating produced is more concentric on average with the aperture, thereby providing better collimation of the electron beam that is produced. The transfer through the aperture is easily within the skill of the art, is cost effective and the method can be performed with the cathode material in a liquid slurry or in a solid preformed foil.

BRIEF DESCRIPTION OF THE DRAWINGS

FIGS. 2 to 5 are broken-away sectional elevational views illustrating steps in the preferred practice of the novel method.

DETAILED DESCRIPTION OF THE PREFERRED EMBODIMENTS

Figure 1:
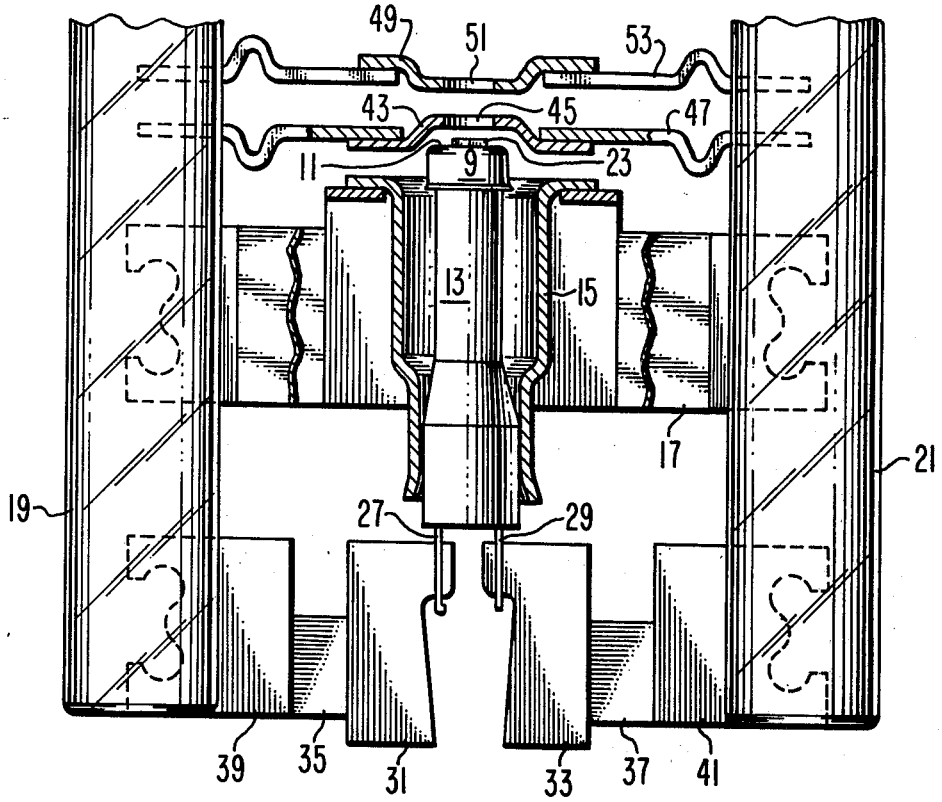
FIG. 1 is a broken-away sectional elevational view of a portion of a typical electron-gun mount assembly for a cathode-ray tube including an indirectly-heated cathode that can be assembled according to the novel method.

The novel method may be applied to making the electron-gun mount assembly shown in FIG. 1. Electron-gun mount assemblies of this type are described in greater detail in U.S. Pat. Nos. 3,772,554 to R. H. Hughes and 3,952,224 to J. Evans, Jr.

The mount assembly shown in FIG. 1 comprises a nickel-alloy cathode cup including a sidewall 9 and an integral endwall 11, which is the cathode substrate. The sidewall 9 is welded to one end of a cylindrical cathode sleeve 13, which is welded at its other end to a cylindrical cathode eyelet 15, which is welded to a cathode support 17, which is embedded in glass beads 19 and 21 on each side thereof. The outer or obverse side of the cathode substrate 11 carries a layer 23 of electron-emissive material. A double-spiraled coated resistance heater wire is located in the sleeve 13. The legs or ends 27 and 29 of the heater wire extend beyond the sleeve 13 and are welded to two tab legs 31 and 33, which are welded to two heater connectors 35 and 37 respectively, which are welded to two heater bead straps 39 and 41 respectively, which are embedded in the two glass beads 19 and 21 respectively.

A first grid 43 having a first grid aperture 45 therein is welded to a grid support 47, which is embedded in the beads 19 and 21. The first grid 43 is spaced a precise and critical distance, referred to as the cathode-to-grid spacing, from the layer 23. A second grid 49 having a second grid aperture 51 therein is welded to a grid support 53, which is embedded in the beads 19 and 21. The cathode-ray tube may have a single electron gun, as shown in FIG. 1. Or, the tube may have two or more such guns spaced closely together in the neck of the tube. For example, the tubes may employ three in-line electron guns as described in the above-cited patents to Hughes and Evans, Jr.

To make the mount assembly shown in FIG. 1 by the practice of the novel method, all of the structural parts shown in the figure except the layer 23 are assembled to the glass beads 19 and 21 by a known method referred to in the art as beading; for example, as described in U. S. Pat. No. 2,950,568 to R. D. Kissinger et al. Then, an elongated support carrying cathode material at its extended end is passed through the second aperture 51 and the first aperture 45 into close proximity with the substrate 11. Then, cathode material is transferred from the support to the substrate. The elongated support is then withdrawn from the assembly through the apertures. Of course, there may only be one grid with one grid aperture in the assembly, or there may be more than two apertured grids in series. If there is more than one grid aperture, then the series of grid apertures should be reasonably well aligned so that the elongated support can pass therethrough.

The preferred practice of the novel method involves cutting or punching a foil piece from a foil containing cathode material, placing the piece on the extended end of an elongated support, then passing that extended end with the foil piece thereon through the grid apertures and transferring the foil piece to the cathode substrate. In one form of the novel method as illustrated in FIGS. 2 to 5, the method employs a commercially-available cathode tape, marketed by Vitta Corporation, Wilton, Conn., which comprises a carrier film of clear plastic about 0.05 mm (2 mils) thick, a layer of particulate cathode material and binder about 0.075 mm (3 mils)

thick, a layer of pressure-sensitive adhesive about 0.01 mm (0.4 mil) thick, and a protective layer of paper about 0.06 mm (2.4 mils) thick. The carrier layer is removed, and the remaining layered structure is placed on a table with the layer of cathode material facing up.

As shown in FIG. 2, the paper layer 61 faces down with the adhesive layer 63 intermediate the paper layer 61 and the layer 65 of cathode material and binder, which faces up. A special tool is used to punch a foil piece from the layered structure. The tool comprises a cylindrical sheath 67 and a plunger or rod 69 therein. One end of the sheath 67 has a sharpened cutting edge 71. In one embodiment, the sheath 67 is a piece of thin-walled stainless-steel tubing cut off square at the working end and then sharpened to an angle so that the inside diameter of the sheath equals the size of the foil piece to be cut. The sheath 67 is positioned with the cutting edge 71 against the cathode-material layer 65 as shown in FIG. 2. Enough pressure is applied to the tool so that it cuts the layer of cathode material 65 and the adhesive layer 63 but does not penetrate the paper layer 61. Then, when the sheath 67 is pulled away, it carries with it the foil piece 73 as shown in FIG. 3. When cutting out the foil piece 73, a cleaner cut is sometimes attained by imparting a slight rotation to the sheath 67 while applying the cutting pressure. Rotation of the cutting tool can be used where the foil piece 73 is circular or near circular or ring shaped. In some cases, a noncircular section, for example, an elliptical or oval shape, may be desired, in which cases, rotation of the cutting tool may not be desirable.

In a particular example for making a cathode for a television picture tube, the desired foil piece is a circular disc about 0.50 mm (20 mils) to be used with grids having round apertures about 0.625 mm (25 mils) in diameter. For that foil piece, the cutting tool or sheath 67 has an inside diameter of about 0.50 mm (20 mils) and an outside diameter of about 0.60 mm (24 mils). The wall thickness of the sheath is about 0.05 mm (2 mils), which provides adequate strength and durability for the sheath. The difference in sizes between the grid apertures and the outside diameter of the sheath of 0.025 mm (1 mil) permits the sheath 67 to be inserted through the grid apertures. The cathode material in the cut foil piece 73 weighs about 16 micrograms, assuming an average density of 8 mg/cm$^2$ and a 3-mil thickness. This compares with about 300 micrograms of cathode material normally used to coat the cathode substrate 11.

The cut foil piece 73 is now applied to the cathode substrate 11. As shown in FIG. 4, sheath 67 carrying the foil piece 73 is passed through the second aperture 51 and the first aperture 45 very close to the substrate 11. The plunger 69 is then operated to push the foil piece 73, and particularly the adhesive layer 63 of the foil piece, into contact with the cathode substrate 11. The plunger 69 and the sheath 67 are then withdrawn through the two apertures 45 and 51, leaving the foil piece 73 adhered to the substrate 11 and substantially concentrically with the two apertures as shown in FIG. 5. The structure may then be assembled into a vacuum electron tube and processed in the normal manner including mounting the assembly on a stem, sealing the stem into the envelope of the tube, removing the volatile matter from the foil piece 73 and then converting the cathode material of the foil into an electron emitter.

The foregoing example employs a commercially-available cathode tape. A suitable foil for use in the novel method can be made by the following procedure. Cathode material consisting essentially of a triple-alkaline-earth carbonate powder (57 weight percent barium carbonate, 39 weight percent strontium carbonate and 4 weight percent calcium carbonate) is coprecipitated by adding a solution of sodium carbonate to a flowing solution of barium, strontium and calcium nitrates. The coprecipitate is washed to remove all soluble salts and then is dried, producing needle-shaped particles averaging about 2 micrometers in size. A binder solution containing 20.3 grams n-butyl methacrylate (a thermally-volatilizable binder) per 100 ml acetone is prepared. Then a mixture comprising 454 gm cathode material,
134 ml binder solution,
384 ml acetone and
4 ml butyl phthalate is rolled in a one-quart alumina jar with half-inch alumina clyinders for about 2 to 16 hours depending on the particle size needed. Shorter rolling times yield larger particle-size cathode material and more porous layers of cathode material.

After the desired rolling time, the slurry is removed from the jar, and a film thereof is cast on a glass or mylar surface using a doctor blade to establish the desired thickness. In one embodiment, in which the slurry was rolled for about 16 hours, a dry foil about 3.2 mils thick had a weight of 20 mg/cm$^2$ when cast from a wet film about 10 mils thick. In another embodiment, a 7-mil-thick wet film produced a 2-mil-thick dry foil with a weight of about 12 mg/cm$^2$. Suitable foil pieces were produced and transferred by the novel method with each of these foils. No adhesive layer was deposited on these foil pieces. However, adequate adhesion was achieved by applying an adhesive layer to the surface of the cathode substrate. The adhesive layer on the cathode substrate, which was applied just before transferring the foil piece, consisted essentially of about 2 weight percent nitrocellulose dissolved in a mixture of diethyl carbonate and diethyl oxalate. Air-bake tests on these foil pieces showed a weight loss of about 5.1 weight percent after baking in air at about 325° C. for about 15 minutes. This is believed to reflect the loss of most of the binder in the foil.

Figure 6:
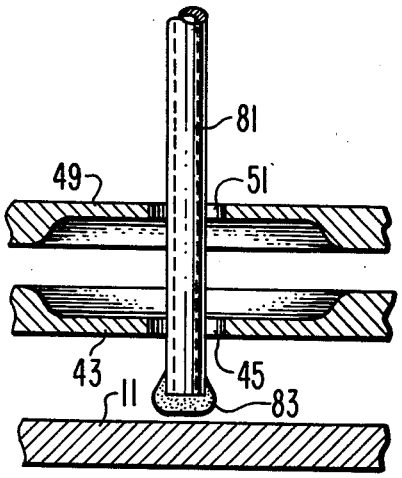
FIGS. 6 and 7 are broken-away sectional elevational views illustrating steps in an alternative practice of the novel method.
Figure 7:
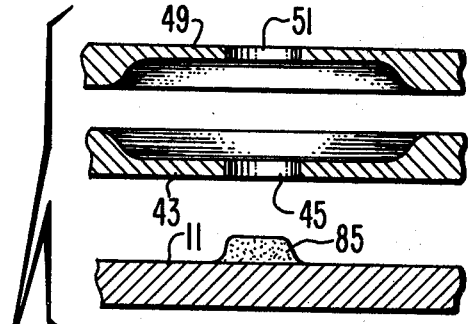

Referring now to FIGS. 6 and 7, the cathode material may be applied as a slurry using a blunt-ended hypodermic needle 81. An amount of the slurry described above is carried by the needle 81 as a droplet 83 through the first and second grid apertures 45 and 51 respectively. The droplet is transferred to the cathode substrate 11 and allowed to spread by its own surface tension, and then to dry by the evaporation of the liquids therein. Shaking the substrate 11 may aid in producing the desired spreading. The needle 81 is removed through the grid apertures 45 and 51, leaving the coating 85 (FIG. 7). To apply a cathode coating 85 containing about 16 micrograms of cathode material by the slurry-dispensing method, about 32 micrograms of slurry having a density of 1.4 gm/ml was applied. Micropipettes and automatic dispensers working in the range of volume required here are available commercially.

I claim:

1. In a method for making an electron gun for a vacuum electron tube having an electron emissive layer on a cathode substrate adjacent to an apertured grid, said grid having at least one beam-forming aperture therein, the steps comprising (a) assembling said cathode substrate and said grid in predetermined fixed spatial relationship, (b) providing an elongated support carrying cathode material at one end thereof, (c) passing said one end through said aperture into close proximity with said substrate.

(d) transferring cathode material from said end to said substrate, (e) and withdrawing said end from said assembly through said aperture.

2. The method defined in claim 1 wherein said end carries a liquid slurry comprising particles of said cathode material in a liquid vehicle.

3. The method defined in claim 2 wherein at least a portion of said slurry is transferred to said substrate, which transferred portion levels itself by the action of its surface tension, and then dries.

4. The method defined in claim 1 wherein said end carries a solid, preformed layer comprising particles of said cathode material in a solid binder.

5. The method defined in claim 4 wherein said layer has a predetermined shape and thickness, and means are included for adhering said layer to said substrate.

6. The method defined in claim 1 wherein said cathode substrate and at least two apertured grids are fixedly assembled in precise and predetermined spaced relationship with respect to each other with the apertures of said grids aligned to permit said elongated support to pass therethrough.

7. A method for making an electron gun for a vacuum electron tube comprising (a) assembling a cathode substrate to at least one grid having one beam-forming aperture therein, (b) attaching to the end of an elongated support having a cross section smaller than said aperture a preformed foil piece comprising alkaline earth carbonates and a thermally-volatilizable binder therefor, said foil having substantially uniform thickness, (c) passing said support end through said aperture until said foil piece contacts and attaches to said cathode substrate, (d) and then withdrawing said support end from said assembly leaving said foil piece attached to said cathode substrate.

8. The method defined in claim 7 wherein said foil piece is punched from a foil directly onto said support end.

9. The method defined in claim 7 wherein said foil carries a layer of pressure-sensitive adhesive on one surface thereof, and said adhesive layer is positioned on said rod end to contact said substrate.

10. The method defined in claim 7 including the step prior to step (c), of applying an adhesive layer upon the surface of said cathode substrate.

* * * * *